US006270238B1

(12) United States Patent
Mendelsohn et al.

(10) Patent No.: US 6,270,238 B1
(45) Date of Patent: Aug. 7, 2001

(54) DURABLE PIVOTAL CONNECTING DEVICE FOR TABLE LAMP

(75) Inventors: Fred M. Mendelsohn, Tampa, FL (US); Simon A. H. Lee, Taoyuan Hsien (TW)

(73) Assignee: Enviromental Lighting Concepts, Inc., Tampa, FL (US)

( * ) Notice: Subject to any disclaimer, the term of this patent is extended or adjusted under 35 U.S.C. 154(b) by 0 days.

(21) Appl. No.: 09/504,402

(22) Filed: Feb. 15, 2000

(51) Int. Cl.[7] ..... F21V 21/00

(52) U.S. Cl. ..... 362/287; 362/413; 362/414; 362/427; 285/907

(58) Field of Search ..... 362/287, 288, 362/410, 414, 418, 427, 413; 285/907

(56) References Cited

U.S. PATENT DOCUMENTS 5,065,297 * 11/1991 Santambrogio ..... 362/413
5,611,510 * 3/1997 Yamamoto ..... 248/205.3
5,695,271 * 12/1997 Zeller ..... 362/98

* cited by examiner

*Primary Examiner*—Stephen Husar
*Assistant Examiner*—John Anthony Ward
(74) *Attorney, Agent, or Firm*—Arhur W. Fisher, III

(57) ABSTRACT

A durable pivotal connecting device for a table lamp between a base and a supporting post of the lamp having a lampshade and a lamp pipe, the supporting post is connected to a rotation seat located in the base and is pivotably assembled with the durable pivotal connecting device for rotation adjustment of the supporting post; the connecting device includes two sets of curved spring leaves, two connecting rods, a transverse bar and an adjusting bolt. The spring leaves are arciform and symmetrically arranged, and each includes a connecting end and is split to form a slit, a positioning end and an adjustment end; screws are used to lock the connecting ends and the positioning ends of the spring leaves onto the inner wall of the base to pivotably mount the rotation seat; the adjustment ends are connected to the connecting rods and the transverse bar to make association of the two sets of spring leaves. The transverse bar has a guide hole allowing passing through of the stem of the adjusting bolt from outside of the base, in order that the transverse bar is moved up and down by adjustment of the adjusting bolt; the adjustment ends of the spring leaves can be operated to give elastic binding action force on the rotation seat, and durability of the pivot area requiring frequent adjustment between the base and the supporting post can be assured.

1 Claim, 3 Drawing Sheets

DURABLE PIVOTAL CONNECTING DEVICE FOR TABLE LAMP

BACKGROUND OF THE INVENTION

1. Field of the invention

The present invention is related to a durable pivotal connecting device for a table lamp between the base and the supporting post of the lamp. The present invention is especially related to a pivotal connecting device taking advantage of the elastic nature of a plurality of bendable spring leaves in assembling an adjusting bolt, a transverse bar and two connecting rods in a linking mode, thereby, frictional resistance at the contact area between a rotation seat and the spring leaves can be controlled to tightly bind and fix or release the rotation seat for the supporting post to get a function of adjustment in rotation angle.

2. Description of the Prior Art

A conventional table lamp seen in the markets is provided on one end of the supporting post with a lampshade and a lamp pipe, while the other end thereof is pivotally mounted on the base of the lamp set, these form the main part of the table lamp. However, no matter the base of the lamp set is placed on or is clamped on a table, there is normally a pivotal connecting structure between the base and the supporting post for such purpose as that the supporting post can be rotationally adjusted for an ideal angle of illumination of the light toward the table. While pivotal connecting structures between bases and supporting posts on the table lamps seen in the markets mostly use the mode of connection with screws and nuts for assembling to have the main and subordinate rotating axles locked in positions in a given looseness of mating, and a conventional effect of adjusting the supporting posts relative to the bases can be obtained. However, the conventional pivotal connecting structures are not durable, the supporting posts are frequently adjusted directly with hands, and the axle pipes of the pivotal connecting structures are assembled and controlled for their tightness of binding with screws and nuts; thereby, pivotal connecting of the supporting posts on the bases will become loose after a long period of use with frequent adjusting, and are unable to get fixed positions with enough frictional resistance any more. Although users can use tools such as screw drivers to adjust the screws and nuts on the loosened pivotal connecting structures to recover suitable tightness of binding of the supporting posts against the bases, it is surely known that, adjustment of tightness of binding between the main and subordinate rotating axles taking advantage of their threads can not afford frictional resistance required in continuous rotational adjustment of the lamp set supporting posts. The pivotal connecting structures certainly will get loose again and again; this shows that durability of the conventional pivotal connecting structures is inferior.

SUMMARY OF THE INVENTION

In view of the above statement, to completely solve the problem of deficiency in durability and stability of a pivotal connecting structure is the motive of studying of the present invention. And thereby, the main object of the present invention is to design and provide a pivotal connecting device with better durability and stability in favor of adjustment of a user.

Another object of the present invention is to provide a pivotal connecting device with better durability and stability in favor of adjustment of a user taking advantage of the principle of frictional braking function generated by braking shoes together with that of elastic compressing and restoring of curved spring leaves.

The pivotal connecting device of the present invention actually is not limited to mating of a supporting post and a base, rather, it points to providing of a cylindrical rotation seat between the supporting post and the base. By assembling of the cylindrical rotation seat in the pivotal connecting device of the present invention, convenience of adjustment and durability of the pivotal connecting device can be improved.

The present invention will be apparent after reading the detailed description of the preferred embodiment thereof in reference to the accompanying drawings.

DETAILED DESCRIPTION OF THE PREFERRED EMBODIMENT

Figure 1:
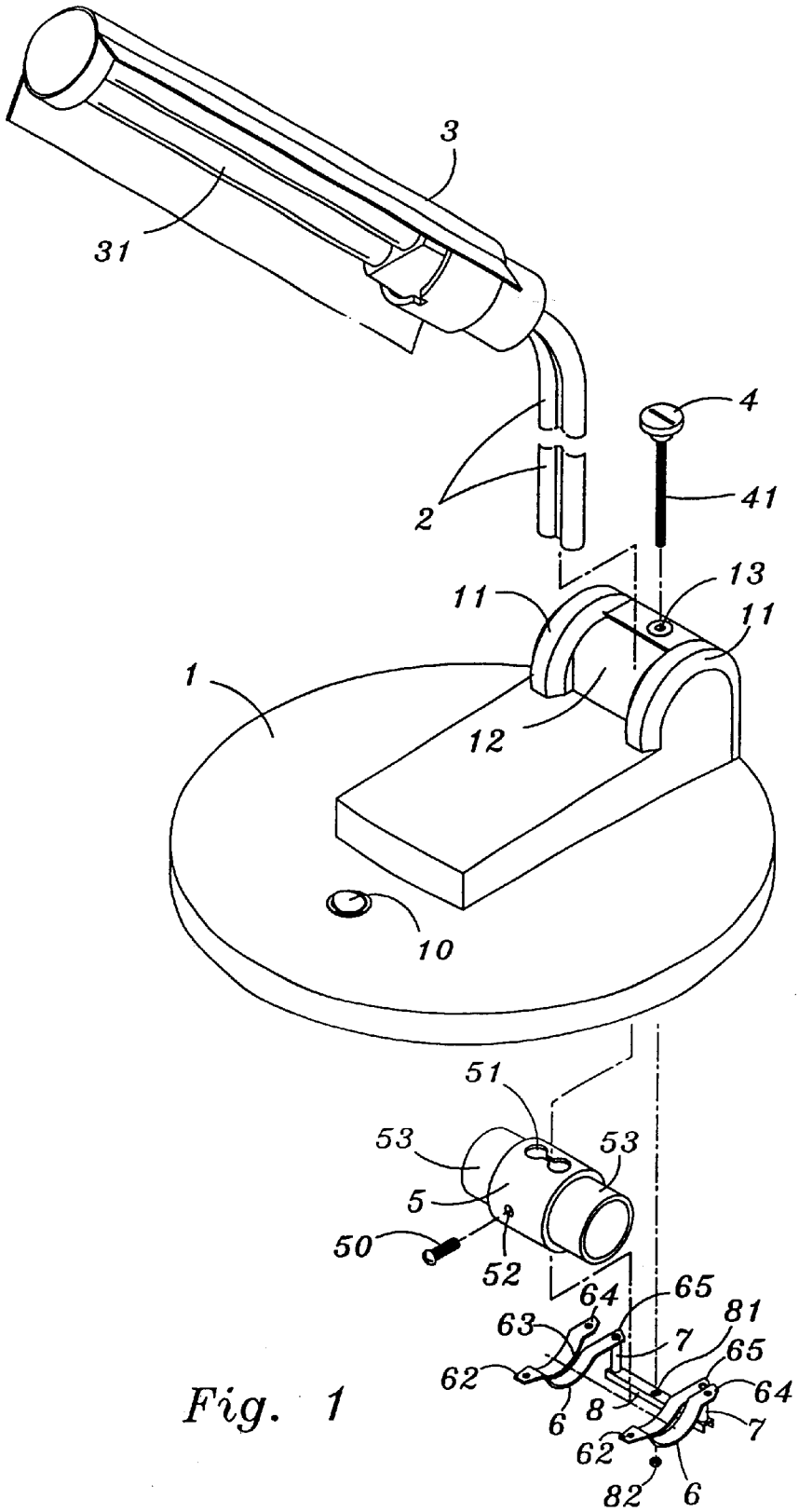
FIG. 1 is a perspective view showing assembling of the present invention.

Referring to FIG. 1 of the drawings, the present invention provides a durable pivotal connecting device for a table lamp between the base and the supporting post of the lamp; the table lamp is comprised mainly of a base 1 and a supporting post 2. One end of the supporting post 2 is provided with a lampshade 3 and a lamp pipe 31 in the lampshade 3. The base 1 is provided therein with a power switch 10. In this structure, the other end of the supporting post 2 is connected to a rotation seat 5 with a screw 50, the other end and the rotation seat 5 are located in the base 1 and are assembled with the durable pivotal connecting device of the present invention.

The rotation seat 5 is provided with an assembling hole 51 in pursuance of the actual shape of the cross section area of the supporting post 2 for insertion of the supporting post 2 into the assembling hole 51. And a screw hole 52 is provided on the rotation seat 5 to receive the screw 50 for lock the rotation seat 5 to the supporting post 2. While both ends of the rotation seat 5 are made to form pivot axle ends 53 with a reduced diameter.

When in practice, the base 1 can be made to have a pivotal connecting seat 11 having an opening 12 for insertion and rotation of the supporting post 2. A top roof of the pivotal connecting seat 11 above the opening 12 is provided with a screw hole 13 to allow extending of an adjusting bolt 4 therethrough for adjustment of the pivotal connecting device.

The pivotal connecting device is comprised of two sets of curved spring leaves 6, two connecting rods 7, a transverse bar 8 and the abovementioned adjusting bolt 4.

Figure 2:
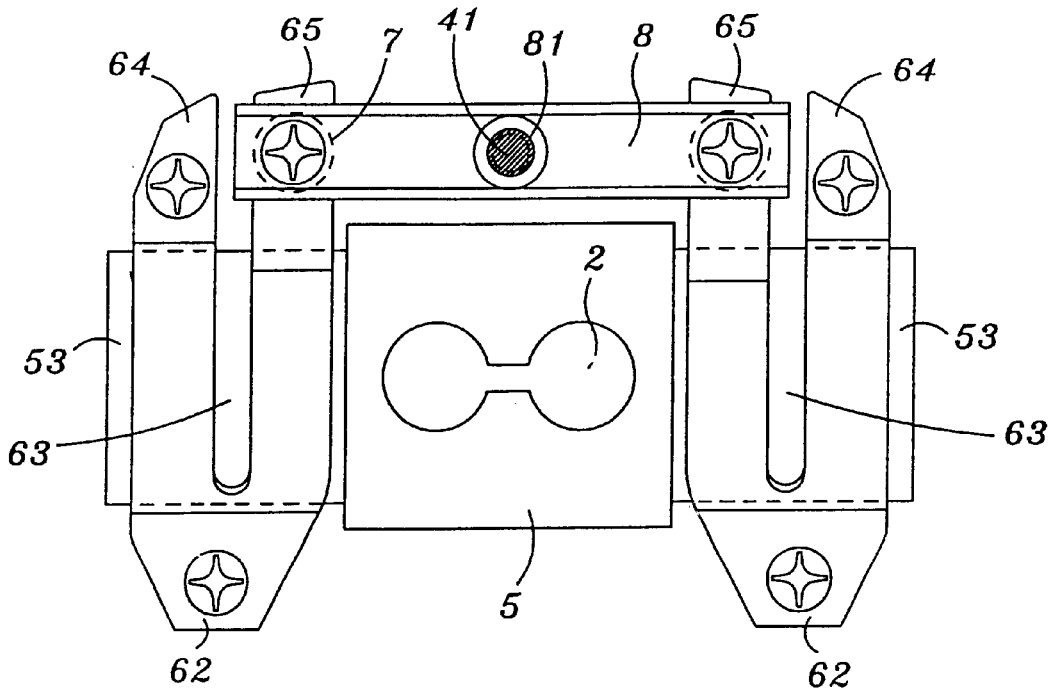
FIG. 2 is a bottom view of the pivotal connecting device of the present invention.
Figure 3:
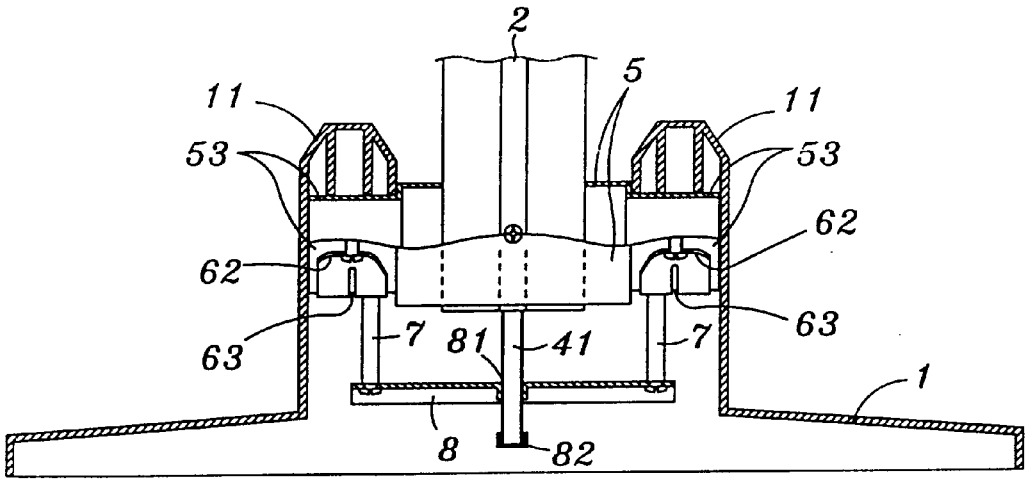
FIG. 3 is a sectional view showing assembling of the present invention.

Wherein, referring to FIG. 2, the two sets of curved spring leaves 6 are symmetrically arranged, and each includes a connecting end 62 and is split to form a slit 63, a positioning end 64 and an adjustment end 65. Screws can be used to lock the connecting ends 62 and the positioning ends 64 of the curved spring leaves 6 onto the inner wall of the base 1. The pivot axle ends 53 of the rotation seat 5 in conformity in shape with the curved spring leaves 6 can thereby be positioned in the base 1 (also referring to FIG. 3 and 4). The adjustment ends 65 of the curved spring leaves 6 is provided for fixedly mounting the two connecting rods 7; the transverse bar 8 is provided on the other ends of the two connecting rods 7. The center of gravity of the transverse bar 8 is provided with a guide hole 81 to hold therein and allow passing through of the stem 41 of the abovementioned adjusting bolt 4. The end of the stem 41 is provided with a stop nut 82, so that the transverse bar 8 can be moved up and down by adjustment of the adjusting bolt 4.

Figure 4:
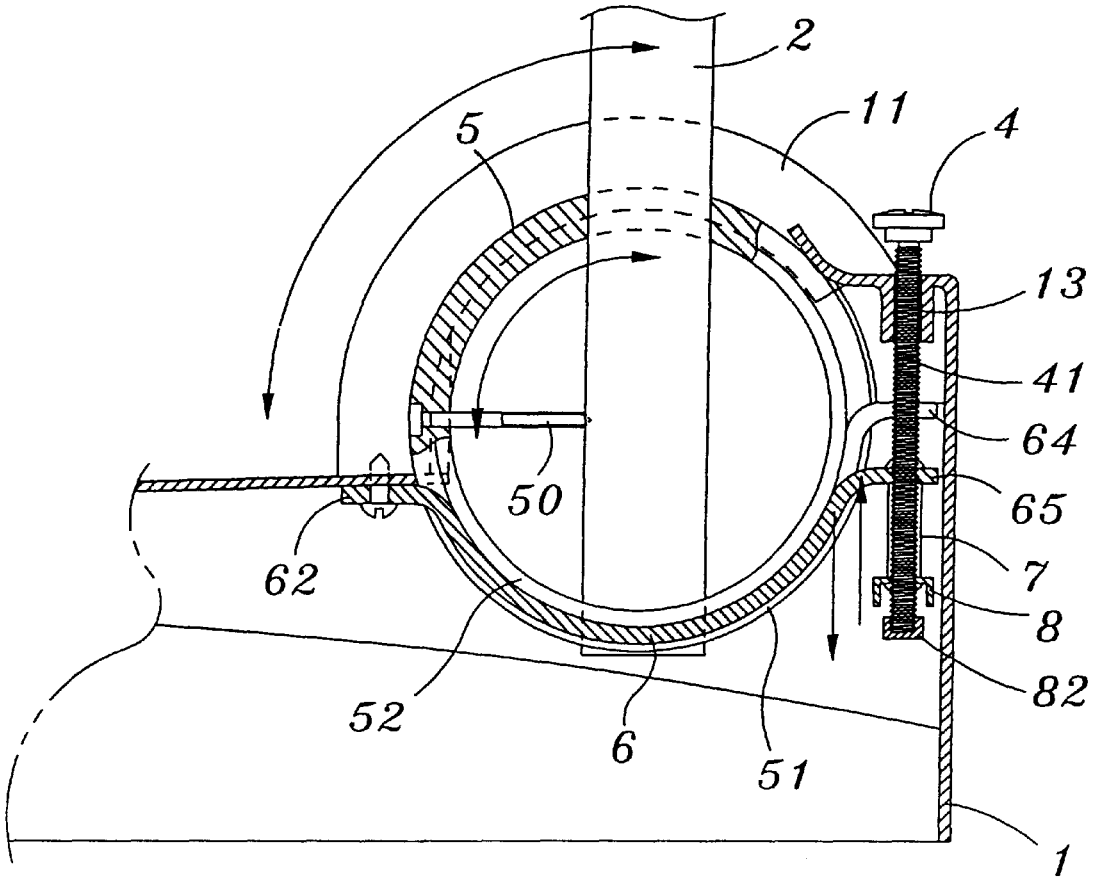
FIG. 4 is another sectional view showing assembling of the present invention.

When in use, as shown in FIG. 4, by the nature of elasticity of the non-fixed adjustment ends 65 of the curved spring leaves 6 in reducing and enlarging diameters of the spring leaves 6, the adjusting bolt 4 can be rotated for adjustment to make the spring leaves 6 on the pivot axle ends 53 be endowed with suitable binding action force to brake the rotation seat 5. Thereby, the rotation seat 5 can be braked firmly by the binding action force (that is the friction force between the spring leaves 6 and the pivot axle ends 53) within the rotating stroke of the supporting post 2. Thereby, the supporting post 2 and the lamp pipe 31 mounted thereon for illumination can be stably positioned after rotation adjustment. And if the pivot axle ends 53 of the rotation seat 5 are worn by rotational abrading of the spring leaves 6 after long period of use, binding action force between the pivot axle ends 53 and the spring leaves 6 required after rotation adjustment of the supporting post 2 on the base 1 can be obtained again promptly by screwing tight the adjusting bolt 4. Hence an extremely stable pivotal connecting device convenient for adjustment is obtained, the durability of the pivot area in rotation adjustment of the supporting post 2 on the base 1 can be ensured.

Having thus described the technical structure of my invention with practicability and improvement, therefore, what I claim as new and desire to be secured by letters patent of the united states is:

What is claimed is:

1. A durable pivotal connecting device for a table lamp between a base and a supporting post of said lamp which has a lampshade and a lamp pipe, said supporting post is connected to a rotation seat which is located in said base and is pivotably assembled with said durable pivotal connecting device for rotation adjustment of said supporting post for illumination; said pivotal connecting device is comprised of two sets of curved spring leaves, two connecting rods, a transverse bar and an adjusting bolt and is characterized in that:

said spring leaves are arciform, and each includes a connecting and and is split to form a slit, a positioning end and an adjustment end;

screws are used to lock said connecting ends and said positioning ends of said arciform spring leaves onto the inner wall of said base, said adjustment ends are not fixed and in the state of capability of elastically reducing and enlarging diameters of said spring leaves;

said connecting rods are respectively locked onto said adjustment ends of said arciform spring leaves, the other ends of said connecting rods are connected to said transverse bar; the center of gravity of said transverse bar is provided with a guide hole to hold therein and allow passing through of the stem of said adjusting bolt from outside of said base, in order that said transverse bar is moved up and down by adjustment of said adjusting bolt;

with the assembly stated above and by adjustment of said adjusting bolt, said adjustment ends of said arciform spring leaves are adapted to be operated to generate elastic binding action force on said rotation seat in said base and are capable of elastically reducing and enlarging diameters of said spring leaves.

* * * * *